United States Patent [19]

Garron et al.

[11] Patent Number: 4,825,789

[45] Date of Patent: May 2, 1989

[54] LOW BOBBIN THREAD DETECTOR

[75] Inventors: Stephen A. Garron, Elizabeth; John N. Wurst, Chester Township, Morris County, both of N.J.

[73] Assignee: SSMC Inc., Shelton, Conn.

[21] Appl. No.: 229,389

[22] Filed: Aug. 8, 1988

[51] Int. Cl.[4] ..... D05B 45/00

[52] U.S. Cl. ..... 112/278; 112/273

[58] Field of Search ..... 112/278, 273, 228, 231, 112/279; 242/37 R

[56] References Cited

U.S. PATENT DOCUMENTS

| | | | |
|---|---|---|---|
| 4,212,257 | 7/1980 | Herron et al. | 112/278 |
| 4,413,581 | 11/1983 | Logan | 112/278 |
| 4,693,196 | 9/1987 | Hager | 112/273 |

*Primary Examiner*—Peter Nerbun

*Attorney, Agent, or Firm*—Robert E. Smith

[57] ABSTRACT

An optical low bobbin thread detector is disclosed utilizing particularly cost effective matrixed light emitting diodes for bobbin thread detection and alarm, and virtually eliminating false alarms by employing a system requiring detection of a predetermined number of successive valid low bobbin thread detections to justify actuation of the alarm.

3 Claims, 3 Drawing Sheets

LOW BOBBIN THREAD DETECTOR

BACKGROUND OF THE INVENTION

1. Field of the Invention

This invention relates to lock stitch sewing machines employing a bobbin on which under or locking thread is wound for concatination with loops of needle thread in the formation of lock stitches. More particularly this invention relates to a novel and advantageously reliable system for monitoring the supply of thread remaining on the bobbin and indicating to the machine operator impending bobbin thread exhaustion.

2. Description of the Prior Art

Low bobbin thread signaling devices are known, as disclosed, for instance, in U.S. Pat. No. 4,178,866, Dec. 18, 1979 of Adams in which reception of a beam of light directed tangentially of the bobbin hub is used to signal low bobbin thread when the bobbin thread is unwound sufficiently to pass the light beam. A problem with such signaling devices is the inability to distinguish from reception of ambient light with resulting frequent false alarms.

The U.S. Pat. No. 4,413,581, Nov. 8, 1983 of Logan discloses an optical low bobbin thread detecting system in which the beam of light tangential to the bobbin hub is generated only in predetermined phases by an LED which is controlled by an oscillator and driver, and an arrangement is provided in order to monitor light reception which is registered only in matching relationship with that of light generated by the LED. Although the phase locked loop does provide a high degree of protection against false signalling as result of ambient light it does involve the expense of LED, oscillator and driver dedicated specifically to low bobbin thread detection, and it is subject to unreliability due to fluctuations in the power supply.

SUMMARY OF THE INVENTION

It is an object of this invention to provide an optical low bobbin thread detector system which is immune to false alarm due to ambient light detection. This is accomplished in this invention by combining an arrangement for establishing as valid only those light reception signals which occur during predetermined periods of signal light emission together with a system for monitoring spurious light detection signals and actuating a low bobbin thread alarm for the sewing machine operator only after reception of valid signals during a predetermined number of successive periods of signal light emission without intervention of any spurious light detection signals.

Another object of this invention is to provide a particularly cost effective low bobbin thread detector of the above description. This object is attained in a sewing machine which includes a matrixed group of LED's for display purposes by utilizing one of the group of LED's as the light emitter in the low bobbin detection system and utilizing the microprocessor logic which controls the matrixed group of LED's to perform the comparator function similar to that of the prior phase locked loop arrangement as well as the logic functions necessary to ensure that the proper number of successive valid low bobbin thread detection signals have been received before an alarm is activated. Where a matrixed group of LED's is included in the sewing machine for other purposes all of the control functions for low bobbin thread detection are available as part thereof without additional cost and as further cost saving the alarm indicating low bobbin thread condition may be provided by utilizing another of the matrixed group of LED's for this purpose.

DESCRIPTION OF THE DRAWINGS

With the above and other objects and advantages in view, as will hereinafter appear, this invention comprises the devices, combinations and arrangements of parts hereinafter described and illustrated in the accompanying drawings of a preferred embodiment in which.

DETAILED DESCRIPTION

Figure 1:
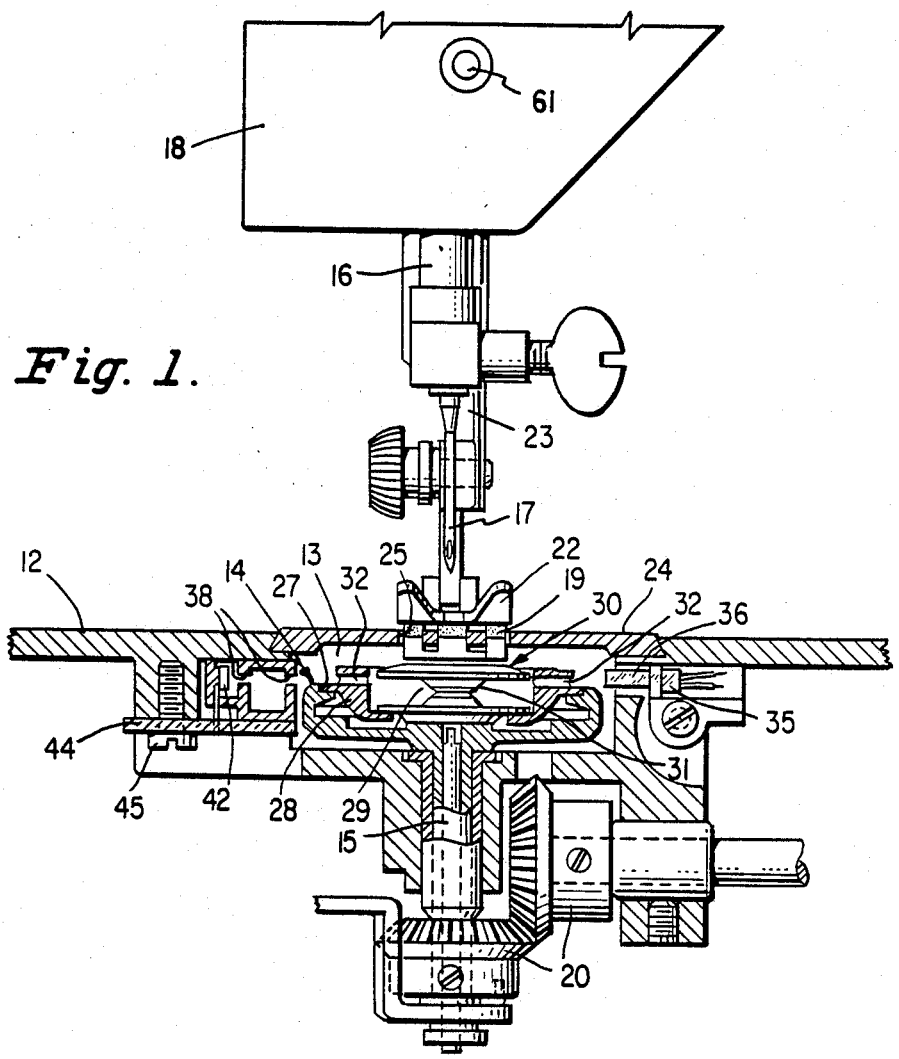
FIG. 1 is front elevational view of the loop taker and bobbin area of a sewing machine shown partly in section in order to show more detail thereof and in which an embodiment of this invention may be incorporated.

Referring now to the drawings, FIG. 1 shows a portion of a sewing machine having a bed 12 and a sewing head 18 overhanging the bed 12. The bed 12 is formed with a cavity 13 in which a loop taker 14 is rotatably carried on one extremity of a shaft 15 oriented so as to have a vertical axis. The shaft 15 is driven by bevel gears 20 which are driven in the usual manner by the main sewing machine drive motor (not shown). The loop taker 14 rotates in timed synchronization to the reciprocation of the needle bar 16, the needle 17 carried by the needle bar 16 being driven in endwise reciprocation through a work material supported in the bed 12 for cooperation with the loop taker 14 carried therein in the formation of stitches. A feed dog 19 is visible which is a portion of a feeding system (not shown) for feeding work material under the sewing needle 17 in order to generate a pattern of stitches. The work material is pressed against the feed dog 19 by a presser foot 22 supported on the end of a presser bar 23 which is urged downwardly in a manner well known in the sewing machine art. A throat plate 24 supports the work material and is fashioned with an orifice (not shown) through which the sewing needle 17 may project. The throat plate 24 is further formed with slots 25 through which the feed dog 19 may extend.

Figure 2:
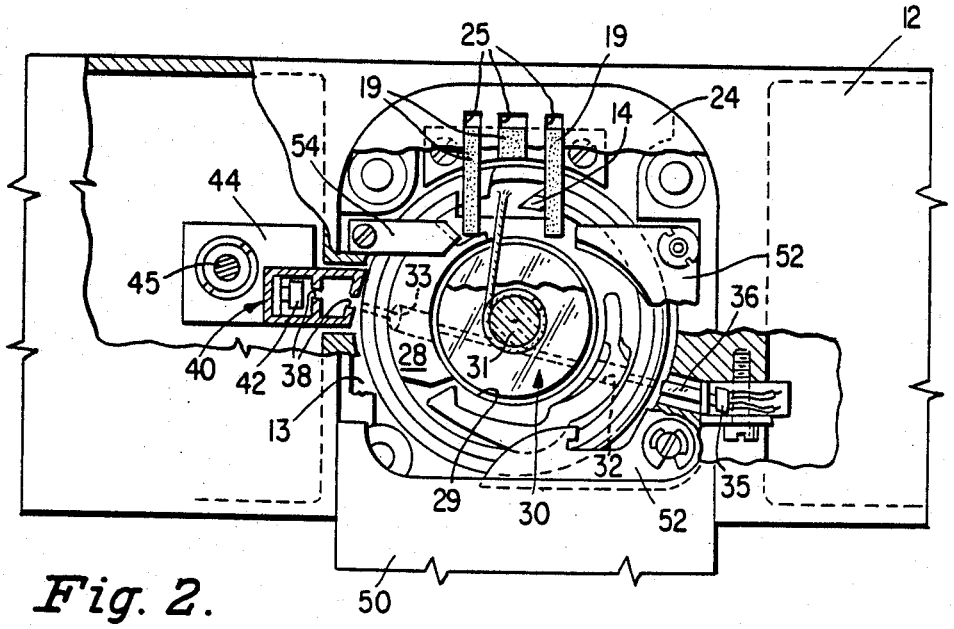
FIG. 2 is a plan view of the loop taker and bobbin area of the sewing machine shown in FIG. 1 indicating the placement of the light detector and a light emitter cooperative therewith.

The loop taker 14 supports on a race 27 thereof a bobbin case 28. The bobbin case 28 is restrained from rotary motion with the loop taker 14 by a position plate 52 (FIG. 2). The bobbin case 28 is fashioned with a cavity 29 within which is supported a bobbin 30 for the carrying of lower thread for a lockstitch. A further explanation of the loop taker 14, the bobbin case 28 and the bobbin 30 arrangement and how thread may be wound thereupon may be had by reference to U.S. Pat. No. 3,693,566. The teachings of this patent have been modified somewhat by extending the bobbin case 28 above the level of the loop taker 14 in order that bores 32, 33 might extend therethrough roughly tangent to the hub 31 of the bobbin 30 (FIG. 2). The purpose of the bores 32, 33 is to allow the passage of light from a light source 35 as focused by a lens 36. The light rays extending from the bore 33 pass through orifices 38 in a mask box 40, which box 40 supports a light detector 42 on an inner wall thereof aligned with the orifices 38 and the bores 32 33. A board 44 is affixed to the bed 12 by means of a screw 45 and the mask box 40 is supported on the board 44 with the light detector 42 having electrical connections thereto.

Referring now to FIG. 2, there is shown a plan view of the left side of the bed 12 showing the cavity 13 therein with the throat plate 24 removed and with a bed slide 50 thereof slid back to expose the loop taker 14, the bobbin case 28 and the bobbin 30. There is also visible a portion of the position plate 52 and a position finger 54 which serve to retain the bobbin case 28 in a stationary position against rotation with the loop taker 14 while permitting thread to be case thereabout.

It will be readily appreciated by one skilled in the art of sewing that it is inconvenient to exhaust the supply of bobbin thread while in the middle of a sewing project. Inasmuch as the bobbin is located within the sewing machine bed 12 over which is draped the garment or fabric being sewn. It will be appreciated that it is difficult to readily observe the quantity of thread remaining on the bobbin while carrying out the sewing process. To the end of alleviating the problems attendant with observing the quantity of bobbin thread, there is provided an indicator, illustratively a light emitting diode 61, preferably mounted on the head 18 of the sewing machine where it is readily visible to an operator, for informing the operator when the amount of thread remaining on the bobbin falls below a predetermined threshold FIG. 3 is a system block diagram of circuitry for controlling the illumination of the indicator 61 in response to the amount of thread remaining on the bobbin 30.

Figure 3:
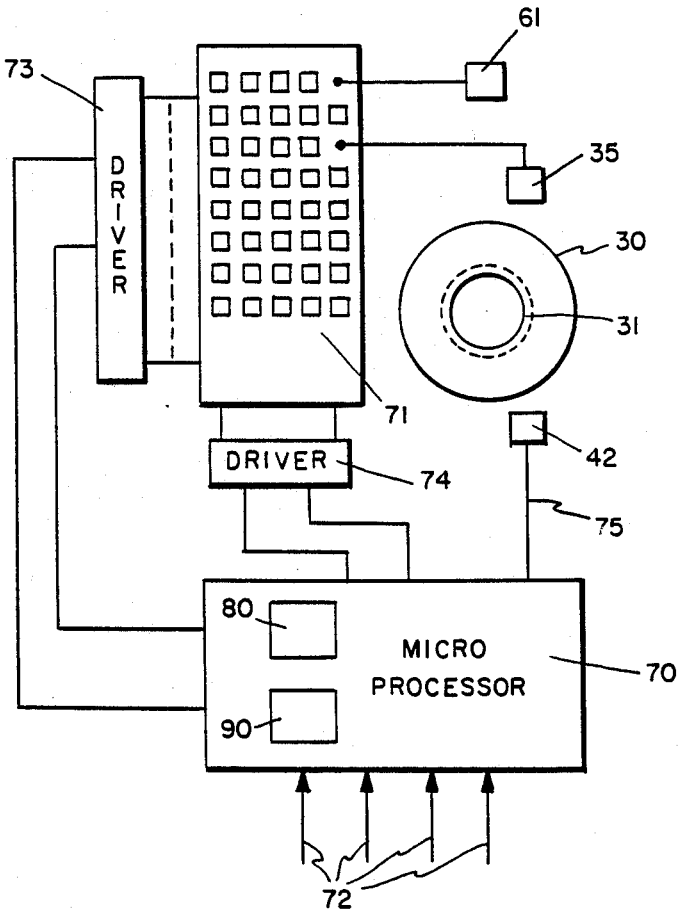
FIG. 3 is a block diagram illustrating a control system constructed in accordance with the principles of this invention for controlling the low bobbin thread detector.
Figure 4:
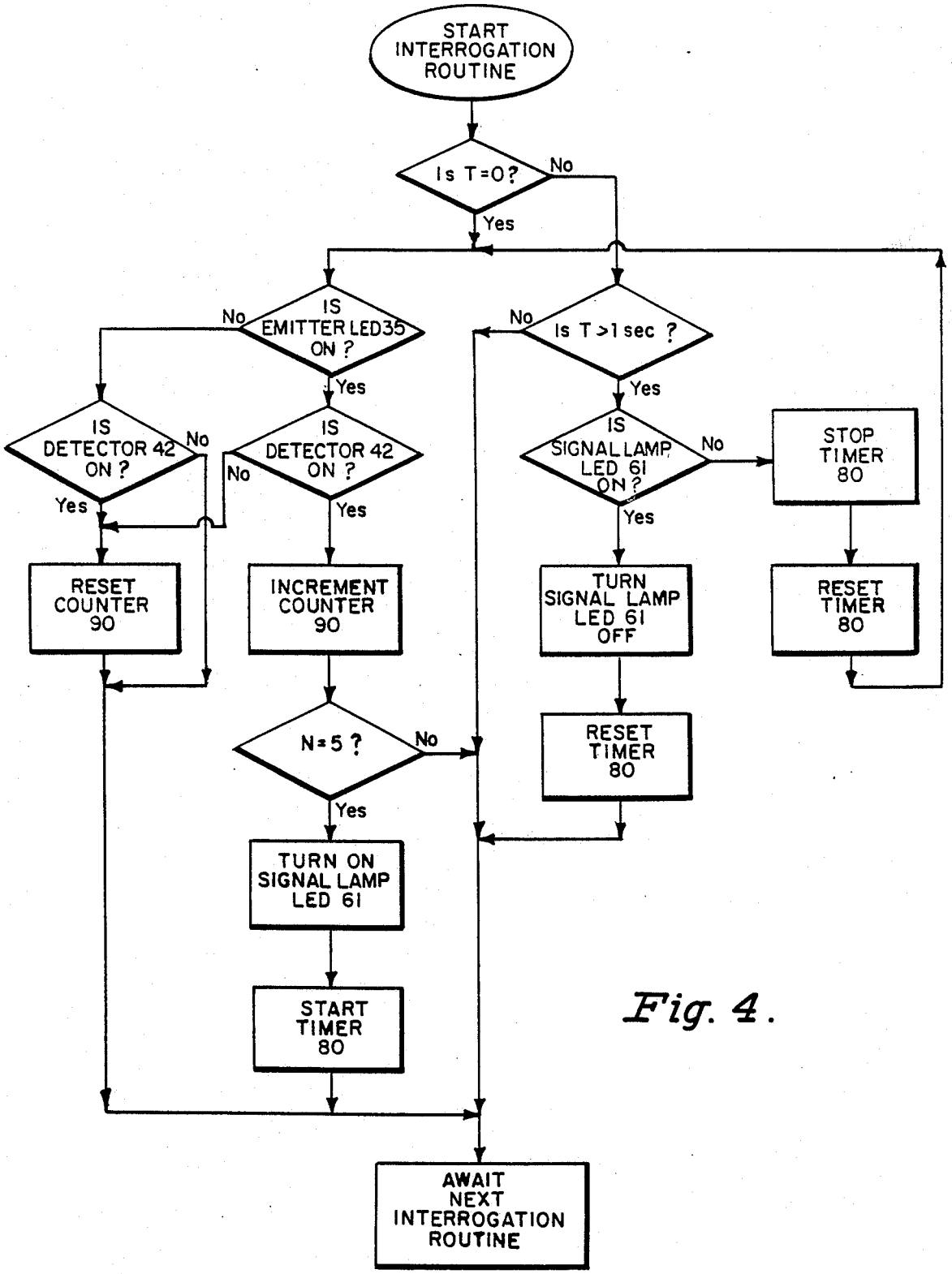
FIG. 4 is a flow diagram illustrating the operation of the microcomputer shown in FIG. 3 to effect low bobbin thread detection and alarm when properly programmed in accordance with this invention.

Referring to FIGS. 3 and 4, of the drawings a microprocessor 70 is shown which has for one of its primary purposes the control of a matrixed group of LED's 71 to display for the sewing machine operator the form and proportion of stitch pattern as it will be produced in accordance with the setting of the various sewing machine controls. The U.S. Pat. No. 4,341,170, July 27, 1982 of Beckerman et al may be referred to for a more complete disclosure of a microprocessor controlled matrixed group of LED's for display purposes, however, for purposes of the present invention it will be sufficient to understand that inputs 72 are provided to the microprocessor from the sewing machine stitch pattern memory, display instructions for each stored pattern in the stitch pattern memory, and from the various operator influenced controls on the sewing machine. The microprocessor delivers output controlling drivers 73 and 74 to the matrixed group of LED's 71. With this arrangement the LED's are multiplexed at a rate indistinguishable to the human eye so that compared with an arrangement in which each LED is provided with its own driver, the number of drivers is greatly reduced with consequent cost saving.

In the present invention, one of the matrixed group of LED's 71 is dedicated to providing the light source for monitoring bobbin thread exhaustion as indicated at 35 in FIG. 3. Another of the matrixed group of LED's 71 is dedicated to providing the alarm signal indicating to the sewing machine operator impending bobbin thread exhaustion as indicated at 61 in FIG. 3. The system of this invention is completed by providing an input line 75 from the light detector 42 to the microprocessor 70. It will be understood that the microprocessor 70 in order to be suitable for serving the purposes of the present invention in addition to controlling the visual display must include capacity for monitoring a timing function preferrably including a timer 80 of at least one second capacity and a counter 90 with ability to store a count of repetitive signal receptions preferrably with capacity of at least 5 repeats FIG. 4 depicts a flow chart of the routine providing by the microprocessor for monitoring bobbin thread exhaustion indication in accordance with this invention. It will be understood that the routine depicted in FIG. 4 will be initiated at the same frequency that the drivers for the matrixed group of LED's 71 are multiplexed by the microprocessor, that is, substantially 30 times per second or more.

The microprocessor first checks the condition of the timer 80. The function of the timer 80 is to maintain the low bobbin thread alarm indicator, LED 61, on and off for approximately one second intervals when a low bobbin thread condition is sensed. If the timer 80 is at any condition other than 0, i.e. the off condition, the routine to the right of FIG. 4 is followed i.e. the microcomputer checks whether the timer 80 has progressed beyond one second, if not the system awaits the next interrogation routine. If the one second time has elapsed the microcomputer asks if the alarm signal LED 61 is on and if so it turns it off, resets the timer and awaits the next interrogation routine; if not it stops, resets the timer, and then initiates one interrogation of the routine depicted to the left in FIG. 4 which is the routine followed in each instance that the off condition of the timer 80 is sensed.

In the routine depicted to the left in FIG. 4 the microcomputer first determines whether the light emitter of the low bobbin thread detector, LED 35 is or is not on following which it determines whether the light detector 42 is or is not on. Only if both the LED 35 and the detector 42 are on simultaneously is valid low bobbin thread condition indicated and the counter 90 incremented. If such coincidence is not registed i.e. if the detector is not on when the emitter is on or if the detector is on when the emitter is off an invalid signal such as influence of ambient light or adequate bobbin thread supply is indicated and the counter is reset in either case.

If the counter 90 is incremented, the microcomputer inquires whether the count has reached a predetermined level, such as 5. If no the system awaits the next interrogation routine; if yes, the signal LED 61 is turned on and the timer 80 is started.

The system described above thus requires a predetermined number, for instance 5, successive valid low bobbin thread detections before the alarm can be actuated or the actuation of the alarm can be continued. In this manner virtually any possibility of false low bobbin thread alarm due, for instance. To ambient light detection is obviated Where matrixed LED's are employed in the sewing machine for other purposes, use thereof for low bobbin thread detection and alarm as taught in the present invention provides a particularly cost effective mode for utilizing the techniques of the present invention.

Having set forth the nature of this invention, what is claimed herein is:

1. In a sewing machine having a frame including a bed, said bed having a cavity for receiving a loop taker, a loop taker rotatably supported in said cavity, a bobbin case supported in said loop taker against rotation therewith, said bobbin case freely supporting a lower thread carrying bobbin therein, and means for sensing the thread carrying condition of said bobbin, said sensing means including a light source, means for intermittently actuating said light source, means for directing light emitted from said light source in a path which is blocked by an adequate supply of lower thread carried on said bobbin, and a light detector arranged in said path at the opposite side of said bobbin from said light source, an arrangement for warning a sewing machine operator of a low bobbin thread condition comprising:

a monitoring system for repeatedly sampling the condition of said light source and of said light detector, means in said monitoring system for recognizing as valid indication of low bobbin thread condition said light detector response only during a period of intermittent actuation of said light source, means in said monitoring system for recognizing as invalid indication of low bobbin thread condition said light detector response during periods other than those of intermittent actuation of said light source, means in said monitoring system for recognizing as indication of adequate bobbin thread supply the absence of response of said light detector during any period of said intermittent actuation of said light source;

a low bobbin thread alarm, and means in said monitoring system for actuating said alarm only after recognition of valid indication of low bobbin thread condition during a predetermined number of successive samplings by said monitoring system uninterrupted by recognition in any sampling of either an invalid indication of low bobbin thread condition or an indication of adequate bobbin thread supply.

2. An arrangement for warning a sewing machine operator of a low bobbin thread condition as set forth in claim 1 in which said light source is provided by one of a matrixed group of light emitting diodes multiplexed in response to a microprocessor; and in which said monitoring system is operated by said microprocessor.

3. An arrangement for warning a sewing machine operator of a low bobbin thread condition as set forth in claim 1 in which said light source and said low bobbin thread alarm are each provided by separate ones of a matrixed group of light emitting diodes multiplexed in response to a microprocessor control, and in which said monitoring system is operated by said microprocessor.

* * * * *